US009675161B2

(12) United States Patent
Castex et al.

(10) Patent No.: US 9,675,161 B2
(45) Date of Patent: Jun. 13, 2017

(54) COSMETIC PRODUCT DEVICE COMPRISING A TRANSPARENT BOTTLE AND PRODUCT

(71) Applicants: Nicolas Castex, Asnieres sur Seine (FR); Julien Seingier, Colombes (FR)

(72) Inventors: Nicolas Castex, Asnieres sur Seine (FR); Julien Seingier, Colombes (FR)

(73) Assignee: Chanel Parfums Beaute, Neuilly sur Seine (FR)

( * ) Notice: Subject to any disclaimer, the term of this patent is extended or adjusted under 35 U.S.C. 154(b) by 9 days.

(21) Appl. No.: 14/892,064

(22) PCT Filed: May 28, 2014

(86) PCT No.: PCT/FR2014/051252

§ 371 (c)(1),
(2) Date: Nov. 18, 2015

(87) PCT Pub. No.: WO2014/191678

PCT Pub. Date: Dec. 4, 2014

(65) Prior Publication Data

US 2016/0113378 A1 Apr. 28, 2016

(30) Foreign Application Priority Data

May 28, 2013 (FR) ..... 13 54809

(51) Int. Cl.

| | |
|---|---|
| ***A45D 40/26*** | (2006.01) |
| ***A45D 34/04*** | (2006.01) |
| *A45D 34/00* | (2006.01) |

(52) U.S. Cl.

CPC ..... *A45D 34/046* (2013.01); *A45D 34/04* (2013.01); *A45D 34/045* (2013.01);
(Continued)

(58) Field of Classification Search

CPC ..... A45D 40/265; A45D 40/267; A45D 2200/053

(Continued)

(56) References Cited

U.S. PATENT DOCUMENTS

2005/0109365 A1 5/2005 Dunton et al.
2007/0267080 A1 11/2007 Babel et al.

FOREIGN PATENT DOCUMENTS

FR 2919478 A1 2/2009
FR 2970474 A1 7/2012

(Continued)

OTHER PUBLICATIONS

International Search Report PCT/ISA/210 and Written Opinion of the International Searching Authority PCT/ISA/237 for International Application No. PCT/FR2014/051252 dated Jul. 22, 2014.

(Continued)

*Primary Examiner* — David Walczak
*Assistant Examiner* — Joshua Wiljanen
(74) *Attorney, Agent, or Firm* — Harness, Dickey & Pierce, P.L.C.

(57) ABSTRACT

The device comprises a container that is transparent, at least in part, and that contains a transparent cosmetic composition; a cap that is suitable for closing the container, preventing any of the composition from leaving the container; and an applicator that is fastened to the cap, and that includes at least one transparent portion that extends into the composition when the container is closed by the cap. The transparent portion of the applicator and the composition have respective refractive indices that present a difference that is less than or equal to 0.075, preferably less than or equal to 0.05, or even less than or equal to 0.03.

19 Claims, 3 Drawing Sheets

(52) U.S. Cl.
CPC ..... *A45D 40/267* (2013.01); *A45D 2034/007* (2013.01); *A45D 2200/053* (2013.01)

(58) Field of Classification Search
USPC ..... 401/126, 127, 128, 129, 130
See application file for complete search history.

(56) References Cited

FOREIGN PATENT DOCUMENTS

| | | | |
|---|---|---|---|
| JP | 2009-035272 | A | 2/2009 |
| WO | WO-2006-032482 | A1 | 3/2006 |
| WO | WO-2007-047168 | A2 | 4/2007 |

OTHER PUBLICATIONS

Written Opinion of the International Searching Authority PCT/ISA/237 for International Application No. PCT/FR2014/051252 dated Jul. 22, 2014.

COSMETIC PRODUCT DEVICE COMPRISING A TRANSPARENT BOTTLE AND PRODUCT

This application is the U.S. National Phase application of PCT Application No. PCT/FR2014/051252 filed May 28, 2014, which claims priority to the French Application No. 1354809 filed on May 28, 2013, the contents of each of which are incorporated herein by reference.

The invention relates to devices including a cosmetic composition.

BACKGROUND OF THE INVENTION

Articles are known that comprise a container containing a makeup composition, and a cap that carries an applicator that is immersed in the composition when the container is closed. By way of example, the composition is a composition for making up the lips or the nails, or a composition for skin care, or a fragrance. In particular, it is known to make the container transparent, so as to see the composition and also the applicator that is situated therein.

Independently of the results obtained by the composition in terms of makeup effect, the appearance of the article itself is an essential element in making it attractive to purchase.

OBJECTS AND SUMMARY OF THE INVENTION

An object of the invention is to improve the attractiveness of such an article. More particularly, an object is to create a surprising effect when the user removes the applicator from the container.

To this end, the invention provides a device that comprises:

- a container that is transparent, at least in part, and that contains a transparent cosmetic composition;
- a cap that is suitable for closing the container, preventing any of the composition from leaving the container; and
- an applicator that is fastened to the cap, and that includes at least one transparent portion that extends into the composition when the container is closed by the cap;

the transparent portion of the applicator and the composition having respective refractive indices that present a difference that is less than or equal to 0.075, preferably less than or equal to 0.05, or even less than or equal to 0.03.

Thus, as a result of the very small difference between the refractive indices, the observer cannot distinguish the applicator and the composition through the container. In other words, the portion of the applicator that is immersed in the composition cannot be seen through the wall of the container. However, the applicator becomes visible as it emerges, carrying on its surface a small quantity of cosmetic composition that is used for creating the makeup effect. The effect of transparency through the container is thus increased considerably, thereby increasing the attractiveness of the device, since the user discovers the applicator and the composition that it carries as the applicator is being removed from the container.

Preferably, the applicator includes a stem, the stem and the composition having respective refractive indices that present a difference that is less than or equal to 0.075, preferably less than or equal to 0.05, or even less than or equal to 0.03.

Thus, the optical invisibility effect is obtained for the stem of the applicator.

Preferably, the applicator includes an endpiece at its free end, the endpiece and the composition having respective refractive indices that present a difference that is less than or equal to 0.075, preferably less than or equal to 0.05, or even less than or equal to 0.03.

Thus, in similar manner, the optical invisibility effect is obtained for the endpiece.

Still more preferably, the container and the composition have respective refractive indices that present a difference that is less than or equal to 0.09, or even less than or equal to 0.07.

Thus, this time, it is the inside edges and the faces of the container that can hardly be seen, if at all, in the composition, thereby increasing still further the general transparency effect.

Advantageously, at least one of the container and the applicator is made of an amorphous copolymer, of polymethylmethacrylate, or of glass.

These materials make it possible to obtain the above-mentioned optical invisibility effects.

Advantageously, the applicator does not have an inside cavity, at least in the portion of the applicator that protrudes from the cap.

This makes it possible to avoid disrupting the optical invisibility effect of the immersed portion of the applicator.

Preferably, the applicator comprises a stem and an endpiece that is distinct from the stem and that is formed integrally with the stem.

Thus, it is possible to avoid generating connection faces which would have been necessary if the two elements had been fitted together. Such faces would have the unfortunate result of spoiling the optical invisibility effect. The invisibility effect is thus also obtained in the junction zone between the stem and the endpiece.

Provision could be made for the applicator to include, at its free end, an endpiece that presents at least any one of the following characteristics:

- it presents a surface treatment;
- it is separated from the stem by a shoulder;
- it has a shape that is generally flat;
- it presents a single plane of symmetry containing an axis of the applicator; and
- it presents two planes of symmetry containing an axis of the applicator.

Provision could be made for the applicator to be interfitted in the cap.

The composition may be makeup for the lips, the eyelids, the cheeks, and/or the nails.

In an embodiment, the composition is colorless.

In another embodiment, the composition is colored.

Provision could be made for the composition to be fatty.

Preferably, the composition is semi-viscous.

Advantageously, the composition comprises at least one of the following elements and preferably all three: polybutene, diisostearylmalate, and octyldodecanol.

These materials make it possible to obtain a composition that creates the above-mentioned optical invisibility effect.

BRIEF DESCRIPTION OF THE DRAWINGS

An embodiment of the invention and variants are presented below with reference to the accompanying drawings, in which.

MORE DETAILED DESCRIPTION

Figure 1:
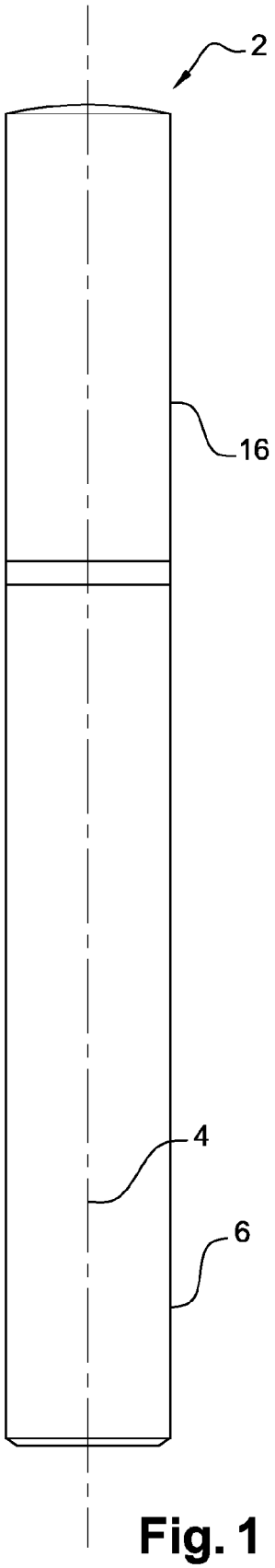
FIGS. 1 and 2 are respectively an elevation view and an exploded perspective view of a device in an embodiment of the invention.
Figure 2:
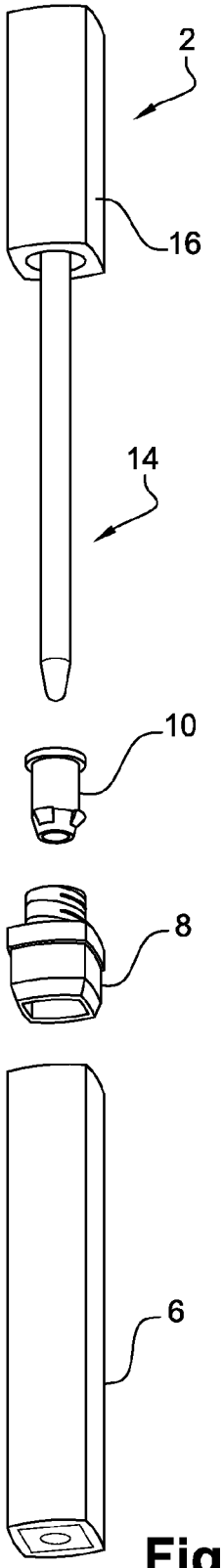
Figure 3:
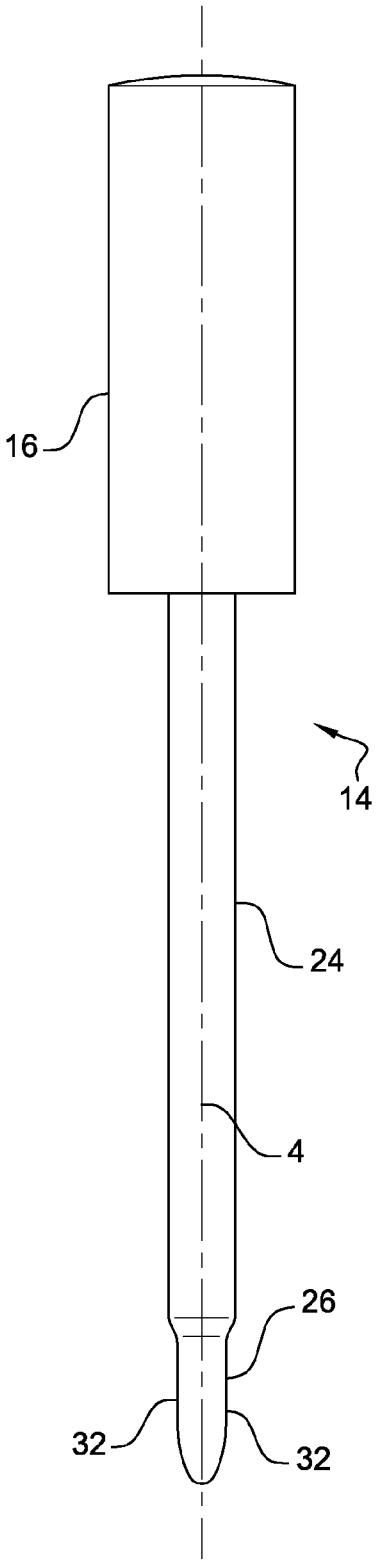
FIGS. 3 and 4 are respectively an elevation view and an axial section view of an applicator of the FIG. 1 device.
Figure 4:
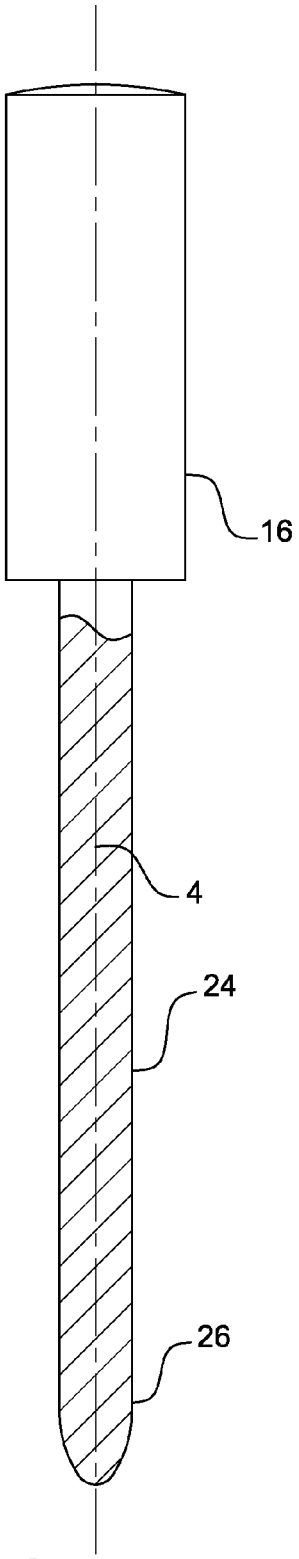

With reference to FIGS. 1 to 7, there follows a description of an article that forms a cosmetic composition device in an embodiment of the invention. The device 2 presents a main longitudinal axis 4. It comprises a container or vial 6, a neck 8, a wiper 10, and an applicator 14 surmounted by a cap 16. All of these elements have the axis 4 as their main axis. They form distinct parts that are fitted together as described below. Some of them are circularly symmetrical about the axis. Furthermore, the container forms a reservoir for a makeup composition 18, shown in FIG. 5.

The container 6 is made as a single piece.

The neck 8 is fastened rigidly to the top end of the container 6, which top end forms the opening thereof. The neck emerges from the top of the container. In addition, the wiper 10 is fastened rigidly to the top end of the neck and extends inside said neck while emerging from the top of said neck.

Other constructions or assemblies are also suitable for the container, the neck, and the wiper.

The applicator 14 and the cap 16 are fastened together rigidly by interfitting the applicator in a housing of the cap, or by means of an intermediate insert that is not described in detail. The applicator and the cap could also be made as a single piece, by injection-molding one or more materials.

In the present embodiment, the container and the cap are in the shape of a section member of section that is square in a plane that is perpendicular to the axis 4. However, they could have some other shape, in particular a shape of section that is circular or octagonal.

The applicator 14 mainly comprises a stem 24 that is connected to the cap 16, and an endpiece 26 that forms the free distal end portion of the applicator. The endpiece extends in alignment with the stem. Specifically, the applicator is formed as a single piece. Furthermore, it does not have an inside cavity in the stem and the endpiece, so that it is solid over the corresponding segments.

On its top portion that emerges from the container 6, the neck 8 carries a thread that is suitable for co-operating with a thread that is formed in the cap 16, so as to form a screw and nut connection that makes it possible to screw-tighten the cap on the neck so that it closes the container in leaktight manner. In this closed position, the applicator 14 bears against the wiper 10 and prevents any of the composition 18 from leaving the container. The only way of accessing the composition, in particular so as to dispense it from the container, is to unscrew the cap so as to open the container. It should be observed that the article does not include an atomizer which would enable the composition to be dispensed from the container when the container is closed by the cap.

Furthermore, in this closed position, the endpiece 26 and a portion of the stem 24 are immersed in the composition 18. The length of the stem that is immersed depends on the level of composition contained in the container.

The container 6, the applicator 14, and the composition 18 are all transparent, i.e. they allow light to pass through them, and it is possible to see through them, albeit with distortion resulting from their respective geometrical shapes. So far as the applicator and the container are concerned, their transparency may be total or partial, i.e. they could present a frosted surface, for example.

In the present embodiment, the applicator is made of polymethacrylate (PMMA). Specifically, the applicator is made of a Plexiglas of 7H PMMA type. It presents a refractive index of 1.49. The applicator is made by injection-molding a thermoplastic.

In the present embodiment, the container is made of an amorphous polymer such as that sold under the name PCTG, and that is remarkable for its transparency. By way of example, the polymer material is Eastar Copolyester DN011 sold by Eastman. It presents a refractive index of 1.566. Other materials may also be suitable, such as Surlyn (registered trademark), or glass.

In the present embodiment, the composition 18 comprises the following elements: polybutene (that has a refractive index of 1.496), diisostearylmalate (Salacos 222 having a refractive index that is equal to 1.461), and octyldodecanol. Specifically, the composition obtained has a refractive index of 1.486. It is liquid, fatty, and semi-viscous. Specifically, it is for making up the lips, and it is a gloss. The composition may include glossy oils, e.g. such as those conventionally used in glosses. Particular examples that may be mentioned are hydrogenated polybutene, polydecene, hydrogenated polydecene, diisostearylmalate, octyldodecanol, phenyl silicone oils such as those sold under the name Silshine 151 by Momentive, or mixtures thereof.

The composition may also include emollient oils such as isostearylic alcohol, phytosteryl/octyldodecyl lauroyl glutamate such as Eldew PS-203 sold by Ajinomoto, or mixtures thereof.

It may also include a transparent gelling agent.

Particular examples of transparent gelling agents that may be mentioned are: polyamide resins, e.g. such as those sold under the name Haimalate PAM by Kokyu Alcohol Kogyo; or derivatives of amino acid, e.g. such as dibutyl lauroyl glutamide sold under the name GP-1 by Ajinomoto, or dibutyl ethylhexanoyl glutamide sold under the name EB-21 by Ajinomoto, or mixtures thereof; or styrene and olefin copolymer based gelling agents, and in particular ethylene/propylene/styrene or butylene/ethylene/styrene copolymers, or mixtures thereof, such as those sold under the trade name KRATON by Shell, or those sold under the trade name VERSAGEL M, ME, ML, MP, MC, MD, and MN by Penreco.

Nevertheless, the invention is also applicable to compositions for making up the eyelids, the cheeks, the nails, or to any type of cosmetic composition or fragrance. In this embodiment, the composition is colorless, but provision could be made for it to be colored (e.g. pinkish or bluish) while being transparent. The same applies for the container and for the applicator.

The difference between the refractive indices of the material of the applicator and of the composition is thus 0.004, which is particularly small. In addition, the difference between the indices of the composition and of the material of the container is 0.080 in this embodiment. Generally, the refractive indices taken into account for the solid materials (in particular the container, the stem, and the applicator) are the refractive indices that are indicated by the supplier of the material under consideration, in the specifications of the material. For the cosmetic composition, the refractive index is measured by means of a laboratory refractometer, in particular an Abbe refractometer temperature regulated at a 20° C.

A difference in indices of 0.004 between the applicator and the formula is not limiting, and it is thought that a satisfactory optical invisibility effect may be obtained with refractive indices of the applicator and of the composition having a difference that is less than or equal to 0.03, or less than or equal to 0.05, or even less than or equal to 0.075.

Likewise, a difference in indices of 0.080 between the container and the composition is not limiting, and it is thought that the optical transparency effect may be obtained in satisfactory manner with a difference in indices that is less than or equal to 0.09, or preferably less than or equal to 0.070.

Figure 5:
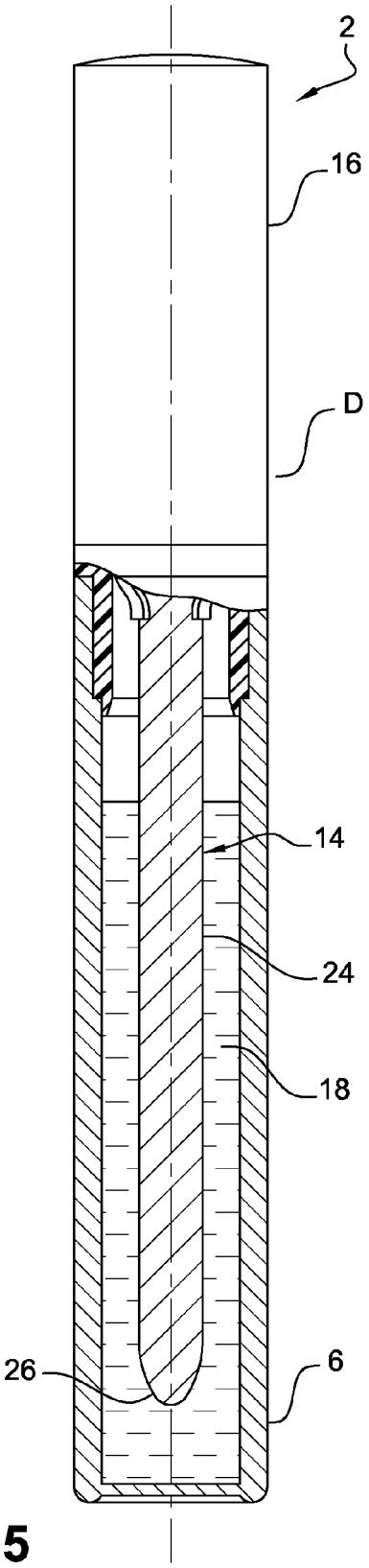
FIG. 5 is an axial section of the FIG. 1 device.
Figure 7:
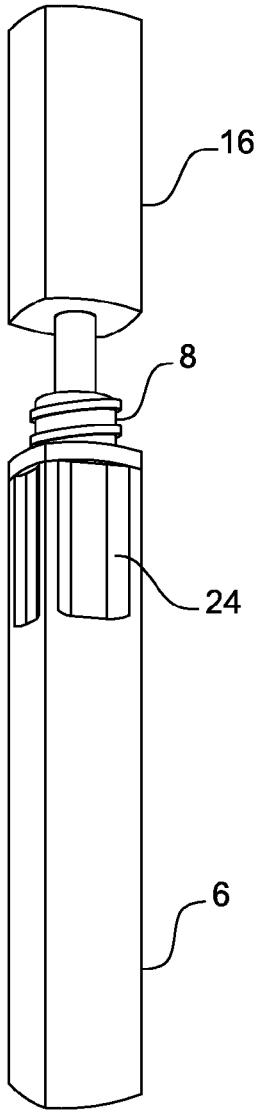
FIG. 7 is a view of the FIG. 1 device, shown partially open.

FIGS. 5 and 7 respectively show the device in its closed state and in its partially-open state while the applicator is being removed from the bottle. When the applicator extends into the composition 18 as shown, the endpiece 26 and the portion of the stem 24 that is immersed in the composition can hardly be seen, if at all, through the wall of the container and the composition, and thus they cannot be distinguished by transparency. Likewise, the inside edges and the faces of the container 6 cannot be seen, and cannot be distinguished from the composition. The entire bottom portion of the container that receives the composition thus has the appearance of a single-piece block that is defined by the outside wall surface of the container.

In order to make it easier to obtain the transparency effect, it is preferable to avoid providing the applicator and the container with edges, or with surfaces of very small radius, since they might generate interfering light reflections that make them visible.

Figure 6:
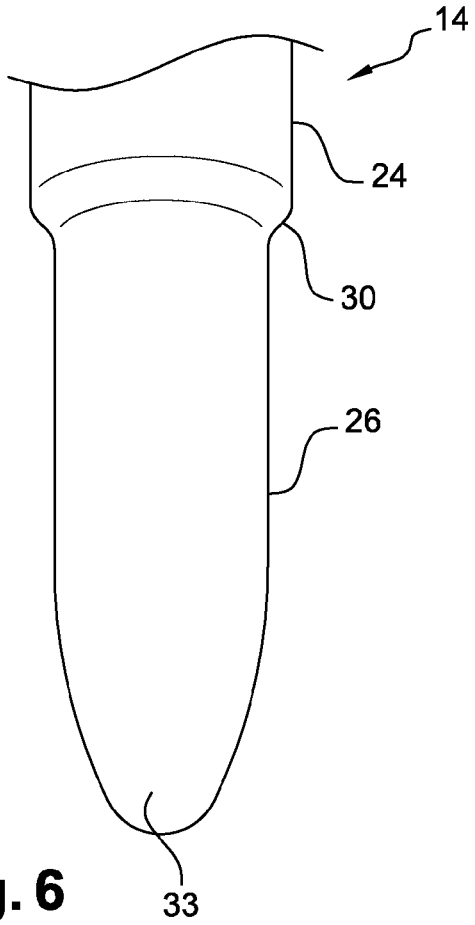
FIG. 6 is a perspective view of the endpiece of the FIG. 3 applicator.

With reference in particular to FIG. 6, the endpiece 26 is separated from the stem 24 by a shoulder 30. The stem has an outside face of cylindrical shape and of circular section in a plane that is perpendicular to the axis 4, and the endpiece presents dimensions in directions that are perpendicular to the axis that are less than or equal to that diameter, thereby generating the shoulder. In this embodiment, the endpiece 26 presents a shape that is generally flat and of constant cross-section in a plane that is perpendicular to the axis of shape that is generally oval or elliptical, thereby forming two main faces 32 on the endpiece, each of which faces may be used for applying the composition to the portion of the face that is to be made up. The free end 33 of the endpiece has a shape that is rounded. In this embodiment, the endpiece presents two planes of symmetry that are perpendicular to each other and that each pass via the axis 4.

Provision could be made to give the endpiece a particular surface appearance, e.g. by means of a surface treatment. By way of example, it is possible to give the surface a frosted appearance that makes it possible to distinguish the endpiece even more relative to the stem, which has a surface that is polished and smooth when the applicator is removed from the container. This treatment does not spoil the above-mentioned transparency effect.

It is also possible to make the cap out of a transparent material, but this is not essential.

In order to apply the makeup, the user unscrews the cap so as to remove the applicator from the container. Then, the user applies the endpiece to the portion of the face that is to be made up, so as to deposit the composition thereon. At this time, it is possible to use the stem as a reservoir of composition, e.g. by encouraging the composition to flow from the stem and onto the endpiece by placing the applicator in the vertical position, as in FIG. 3. On being removed from the container, the applicator and the composition that coats it become visible progressively, given that they are situated in the air that has a refractive index that is close to 1. The user is thus surprised at discovering the applicator in its entirely.

Naturally, numerous modifications could be applied to the invention without going beyond the ambit thereof.

In particular, the endpiece 26 could have any other shape that is suitable for applying the composition, knowing that it is preferable for it to be made integrally with the stem, without any hollow zones or recesses, and avoiding any sharp edges.

Equally, it is possible to modify the formulation of the composition.

It is possible to make the container out of polymethylmethacrylate, out of glass, or out of some other material. It is possible to make the applicator out of amorphous copolymer, out of glass, or out of some other material.

It is possible to make the container so that certain portions only of said container are transparent. In this way, the top portion of the container 6 could be made opaque, e.g. by installing a ring. The same applies to the applicator.

Although the above-described applicator is rigid, provision could be made for it to be flexible, at least in part, e.g. being provided with extra thin stems at its end.

It is possible to give the endpiece shapes other than the shapes described above.

The invention claimed is:

1. A device comprising:

a container that is transparent, at least in part, and that contains a transparent cosmetic composition;

a cap that is suitable for closing the container, preventing any of the composition from leaving the container; and an applicator that is fastened to the cap, and that includes at least one transparent portion that extends into the composition when the container is closed by the cap;

the transparent portion of the applicator and the composition having respective refractive indices that present a difference that is less than or equal to 0.075, preferably less than or equal to 0.05, or even less than or equal to 0.03.

2. A device according to claim 1, wherein the applicator includes a stem, stem and the composition having respective refractive indices that present a difference that is less than or equal to 0.075, preferably less than or equal to 0.05, or even less than or equal to 0.03.

3. A device according to claim 1, wherein the applicator includes an endpiece at its free end, the endpiece and the composition having respective refractive indices that present a difference that is less than or equal to 0.075, preferably less than or equal to 0.05, or even less than or equal to 0.03.

4. A device according to claim 3, wherein the endpiece is separated from the stem by a shoulder.

5. A device according to claim 3, wherein the endpiece has a shape that is generally flat.

6. A device according to claim 3, wherein the endpiece presents a single plane of symmetry containing an axis of the applicator.

7. A device according to claim 3, wherein the endpiece presents two planes of symmetry containing an axis of the applicator.

8. A device according to claim 1, wherein the container and the composition have respective refractive indices that present a difference that is less than or equal to 0.09, or even less than or equal to 0.07.

9. A device according to claim 1, wherein at least one of the container and the applicator is made of an amorphous copolymer, of polymethylmethacrylate, or of glass.

10. A device according to claim 1, wherein the applicator does not have an inside cavity, at least in the portion of the applicator that protrudes from the cap.

11. A device according to claim 1, wherein the applicator comprises a stem and an endpiece that is distinct from the stem and that is formed integrally with the stem.

12. A device according to claim 1, wherein the applicator includes, at its free end, an endpiece that presents a surface treatment.

13. A device according to claim 1, wherein the applicator is interfitted in the cap.

14. A device according to claim 1, wherein the composition is makeup for the lips, the eyelids, the cheeks, and/or the nails.

15. A device according to claim 1, wherein the composition is colorless.

16. A device according to claim 1, wherein the composition is colored.

17. A device according to claim 1, wherein the composition is fatty.

18. A device according to claim 1, wherein the composition is semi-viscous.

19. A device according to claim 1, wherein the composition comprises at least one of the following elements and preferably all three: polybutene, diisostearylmalate, and octyldodecanol.

* * * * *